US007681618B2

(12) United States Patent
Nicolosi

(10) Patent No.: US 7,681,618 B2
(45) Date of Patent: Mar. 23, 2010

(54) SYSTEM FOR OPERATING A PLAIN BLIND

(75) Inventor: Giovanni Nicolosi, Dresano (IT)

(73) Assignee: Pellini S.p.A., Codogno (Lodi) (IT)

( * ) Notice: Subject to any disclaimer, the term of this patent is extended or adjusted under 35 U.S.C. 154(b) by 277 days.

(21) Appl. No.: 10/573,631

(22) PCT Filed: Nov. 5, 2003

(86) PCT No.: PCT/IT03/00715

§ 371 (c)(1),
(2), (4) Date: Mar. 28, 2006

(87) PCT Pub. No.: WO2005/033462

PCT Pub. Date: Apr. 14, 2005

(65) Prior Publication Data

US 2007/0068635 A1 Mar. 29, 2007

(30) Foreign Application Priority Data

Oct. 3, 2003 (IT) ..... MI2003A1902

(51) Int. Cl.
*A47H 1/00* (2006.01)
*E06B 3/32* (2006.01)
*A47G 5/02* (2006.01)

(52) U.S. Cl. ..... 160/98; 160/241

(58) Field of Classification Search ..... 160/23.1, 160/26, 98, 107, 238, 239, 241, 243, 245, 160/265, 310, 313, 314, 315, 316, 319, 171
See application file for complete search history.

(56) References Cited

U.S. PATENT DOCUMENTS

| | | | | | |
|---|---|---|---|---|---|
| 64,101 | A * | 4/1867 | Hatshorn | 160/314 |
| 1,274,768 | A * | 8/1918 | Petro | 160/266 |
| 3,186,473 | A * | 6/1965 | Myers et al. | 160/26 |
| 4,766,941 | A * | 8/1988 | Sloop et al. | 160/241 |
| 4,979,552 | A * | 12/1990 | van der Zanden | 160/107 |
| 5,172,745 | A * | 12/1992 | Wang | 160/370.22 |
| 5,184,660 | A * | 2/1993 | Jelic | 160/171 |
| 5,769,142 | A | 6/1998 | Nicolosi | |
| 6,354,354 | B1 * | 3/2002 | Schmidt | 160/98 |
| 6,715,528 | B2 * | 4/2004 | Rossini | 160/107 |

FOREIGN PATENT DOCUMENTS

| | | |
|---|---|---|
| EP | 0 345 007 | 12/1989 |
| FR | 1 313 315 | 12/1962 |
| WO | 03/071082 | 8/2003 |

* cited by examiner

*Primary Examiner*—Katherine W Mitchell
*Assistant Examiner*—Jeremy C Ramsey
(74) *Attorney, Agent, or Firm*—Michael J. Striker

(57) ABSTRACT

System for operating a plain blind within a glass-enclosed chamber having a first end fixed to a blind-roller by means of devices that pull on said blind-roller and on the second end of the blind.

5 Claims, 10 Drawing Sheets

Figure 1:
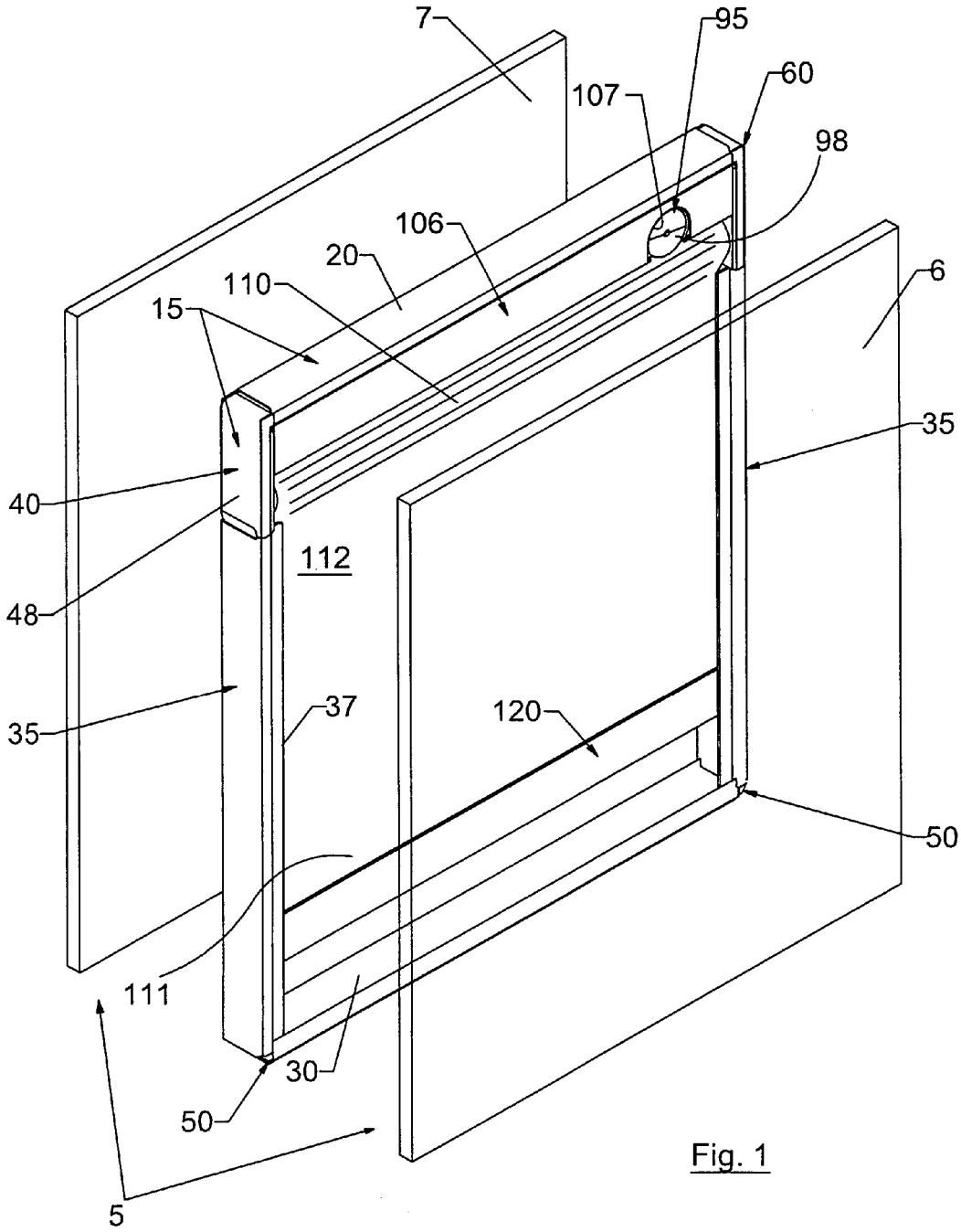

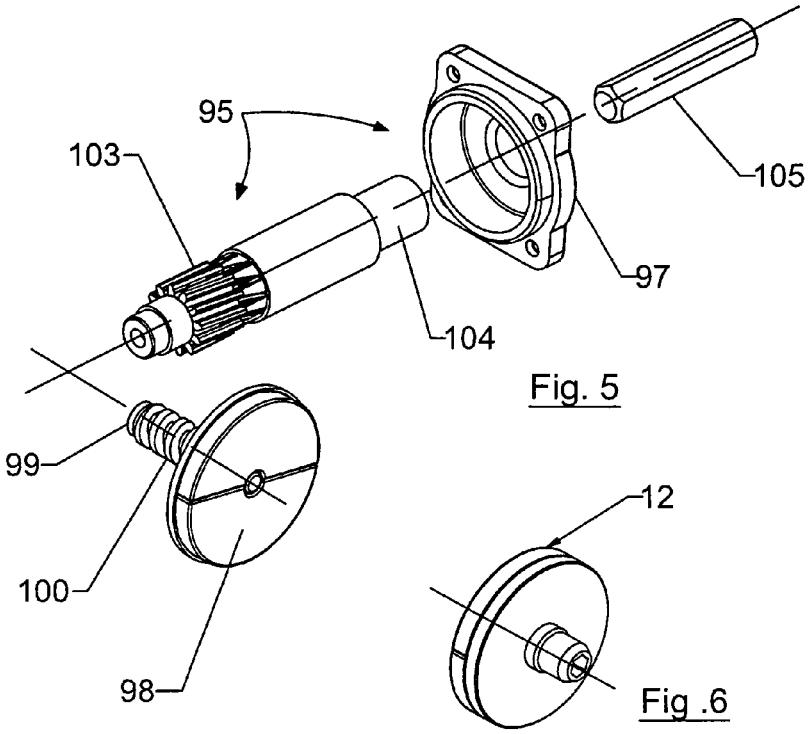
Fig. 5
Fig .6
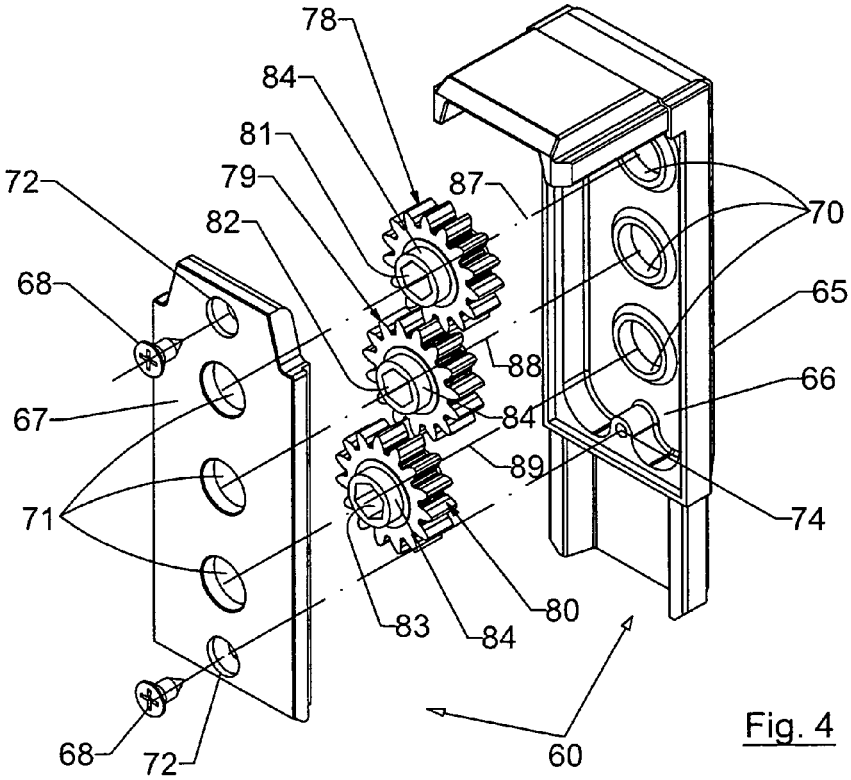
Fig. 4

SYSTEM FOR OPERATING A PLAIN BLIND

The invention concerns devices for working blinds inside a glass-enclosed chamber.

Having to operate from outside a blind hung inside a glass-enclosed chamber is a complicated matter as it must be done without damaging the chamber's hermetic seal.

The devices required for this purpose are generally complex and costly.

In the case of a plain blind gravity becomes a decisive factor so that glass-enclosed chambers in which the blind moves vertically generally need simpler operating devices than those required if the blind is to be set in any other way.

The present invention makes it possible to work the blind whatever its orientation may be within the chamber, using means and a structure of extreme simplicity at a considerably lower cost and at greater operating convenience as will now be explained.

Subject of the invention is a system for working a smooth type of blind inside a glass-enclosed space the frame for which consists of channel-shaped bars joined by four corner pieces, one end of the blind being fixed to a blind-roller, where it is subjected to two pulling devices, one acting on the roller and therefore on a first end of the blind, and the other on the blind's free end.

An oblong-shaped corner piece of the frame, close to the blind-roller, presents a kinematic mechanism comprising a set of three coplanar gears, the central one of which is idle.

These three pinion gears, aligned inside a cavity between two opposing parallel walls in the oblong body of the corner piece, present shaped axial holes surrounded on both sides by collars freely turning in holes situated opposite each other in the two walls.

Terminal pins are inserted in the holes of the first and second pinions said pins, shaped to correspond with the shape of the holes respectively for each pulling device operating on the blind-roller.

In one type of execution with the blind hung vertically, the pulling device for the second end of the blind is a heavy bar fixed to said second end.

In one type of execution the device pulling the blind-roller is a device containing a helical spring wound onto a roller, one end of said spring being connected to a fixed support and the other end to a terminal pin shaped to correspond with the shape of the hole in the first pinion of the kinematic mechanism on the corner piece of the frame round the glass enclosing the chamber, said terminal pin being fitted into the hole in said pinion.

A means for pulling on the second end of the blind, presents a shaped bar fixed to a first end of a roller for a cord (cord-roller) that winds round itself a cord hooked to the centre of a bar fixed to the second end of the blind, said roller translating axially, to allow space for the turns made by the cord, under pressure from a threaded bushing fixed to the second end of this cord-roller, that screws into a threaded bar fixed to the frame of the glass-enclosed chamber, at a position corresponding to said second end of the cord-roller worked by a pulling device.

In some executions the pulling device, acting on the blind-roller or on the cord-roller, consists of a kinematic mechanism comprising a short longitudinal shaft joined at 90°, by means of a pair consisting of a pinion and worm screw, to the short shaft of a magnetic disk substantially matching with the internal surface of the glass enclosing the chamber, which disk is caused to rotate by a second magnetic disk forming part of an external operating means, matching with the first magnetic disk, through the external surface of said glass, inside the chamber.

Said external operating means can comprise a continuous cord operated by hand and fitted to a pulley fixed to a gearing-up device, or may consist of an electric motor.

In some executions the means pulling on the blind-roller or on the cord-roller, is an electric motor fed and operated through electric wiring connected to main electricity and passed in a sealed passage through the frame of the glass-enclosed chamber.

The invention offers evident advantages.

By means of the pulling devices acting on the two ends of the blind, the first end of which is fixed to a roller, the blind can be wound up or let down either by an external magnetic means which, through one of the panes of glass operates a magnetic device inside the chamber, or by an electric motor.

Whatever orientation is given to the blind, the most suitable device can be chosen for the case in point, and therefore both manually or by means of an electric motor.

In any of the possible alternatives offered by the invention, the blind can be wound up or down with the greatest ease but also with maximum safety using the most economic and effective pulling means, according to the position of the blind in space, such as the force of gravity, or by an internal magnetic device set in motion by an external magnetic device, or again by an electric motor.

By means of the described invention the smooth type of blind can be operated within a glass-enclosed chamber in an inexpensive, reliable and extremely simple manner.

Characteristics and purposes of the invention will be made still cleared by the following examples of its execution illustrated by diagrammatically drawn figures.

FIG. 1 Glass-enclosed chamber comprising a frame consisting of four channel-shaped bars and four corner pieces, the blind, wound round a roller of a small diameter, being operated magnetically from inside but controlled from outside the chamber, said roller being situated in a box fixed above, the blind being unwound by gravity pulled by a mobile bar attached to the lower end of the blind, perspective.

Figure 2:
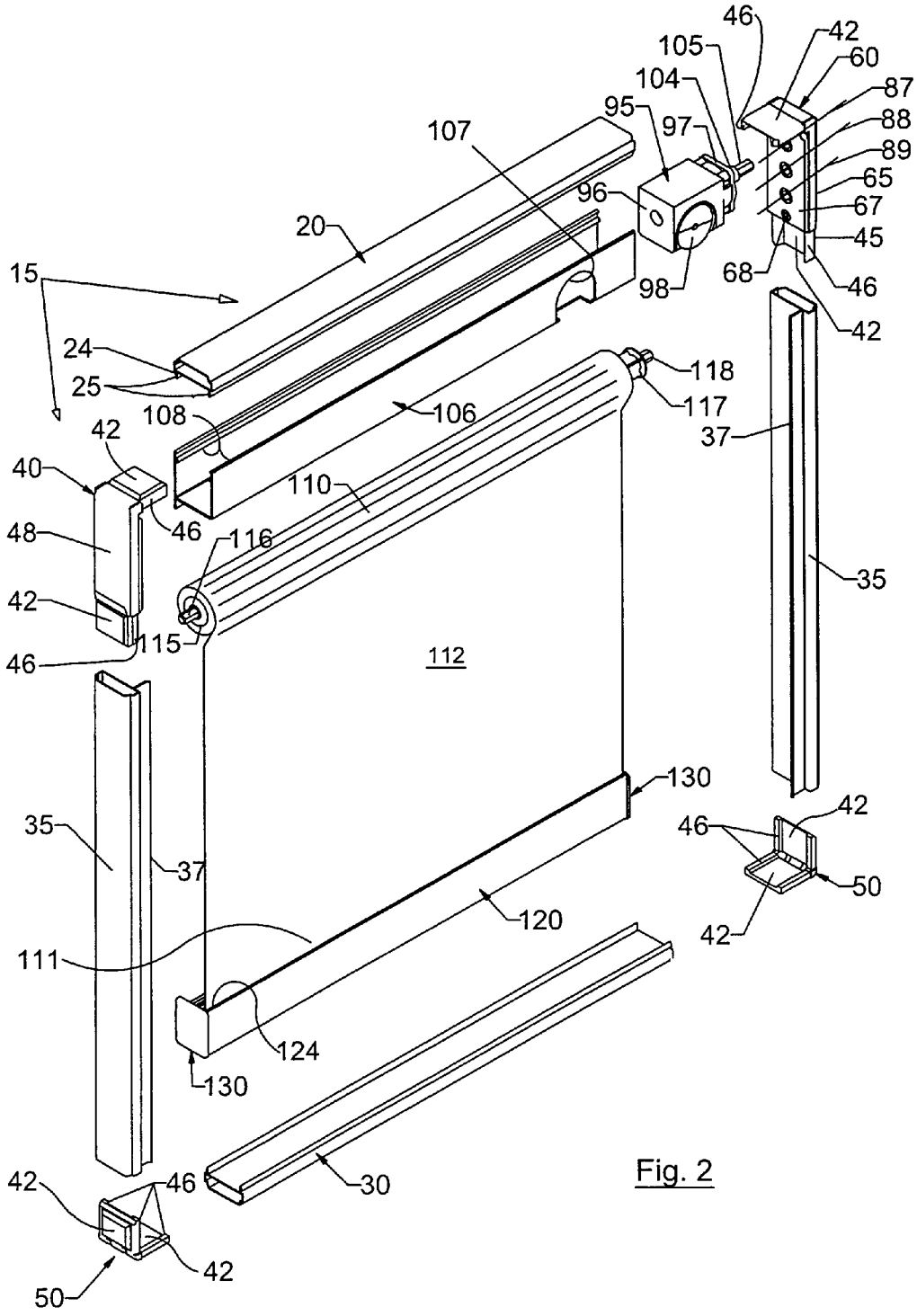

FIG. 2 Exploded perspective view of the frame.

Figure 3:
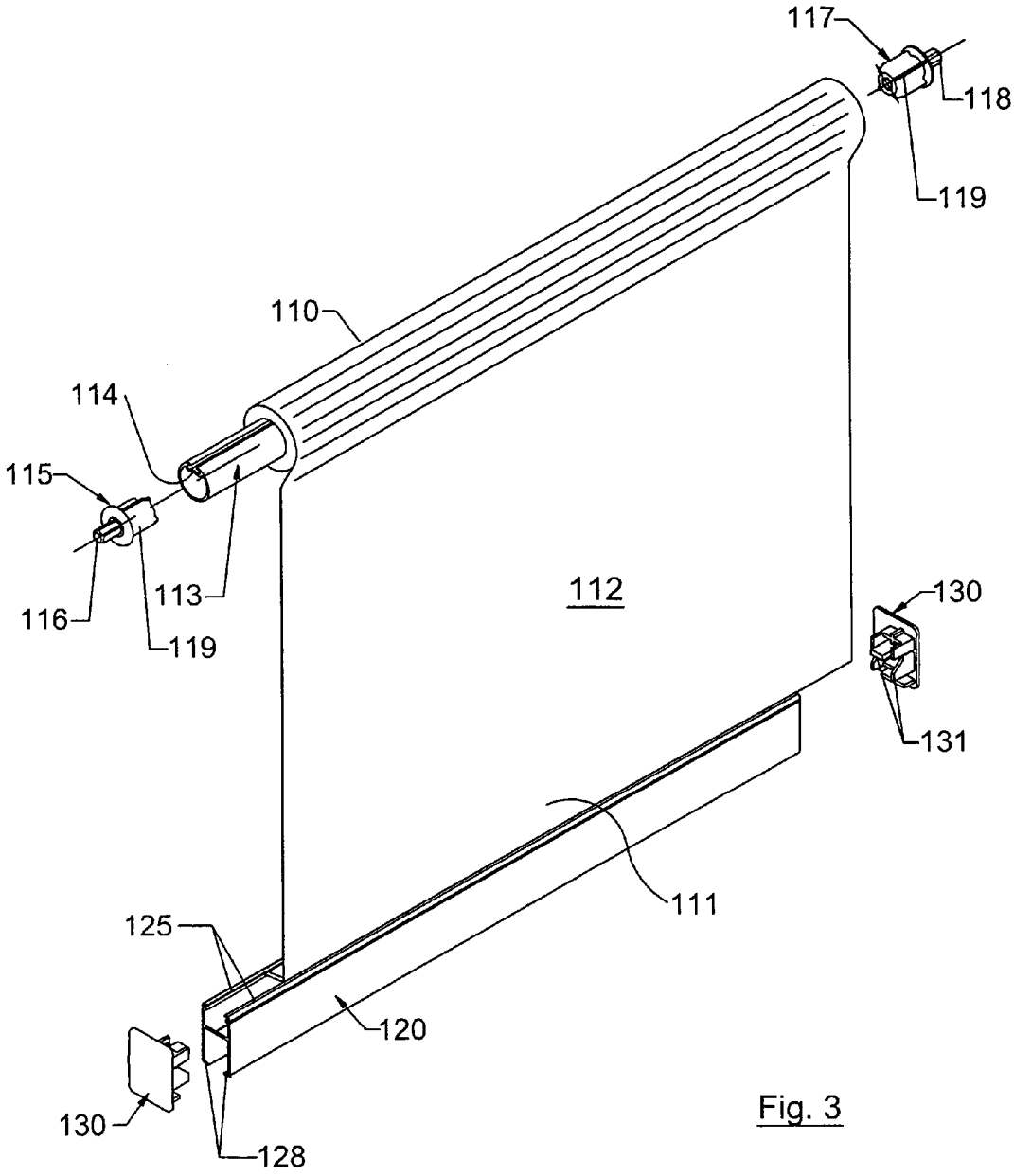

FIG. 3 Detail of the blind, exploded perspective view.

FIG. 4 Upper right-hand corner piece, exploded perspective view.

FIG. 5 Internal magnetic operating device, exploded perspective view

FIG. 6 Magnetic disc of an external magnetic control, perspective.

Figure 7:
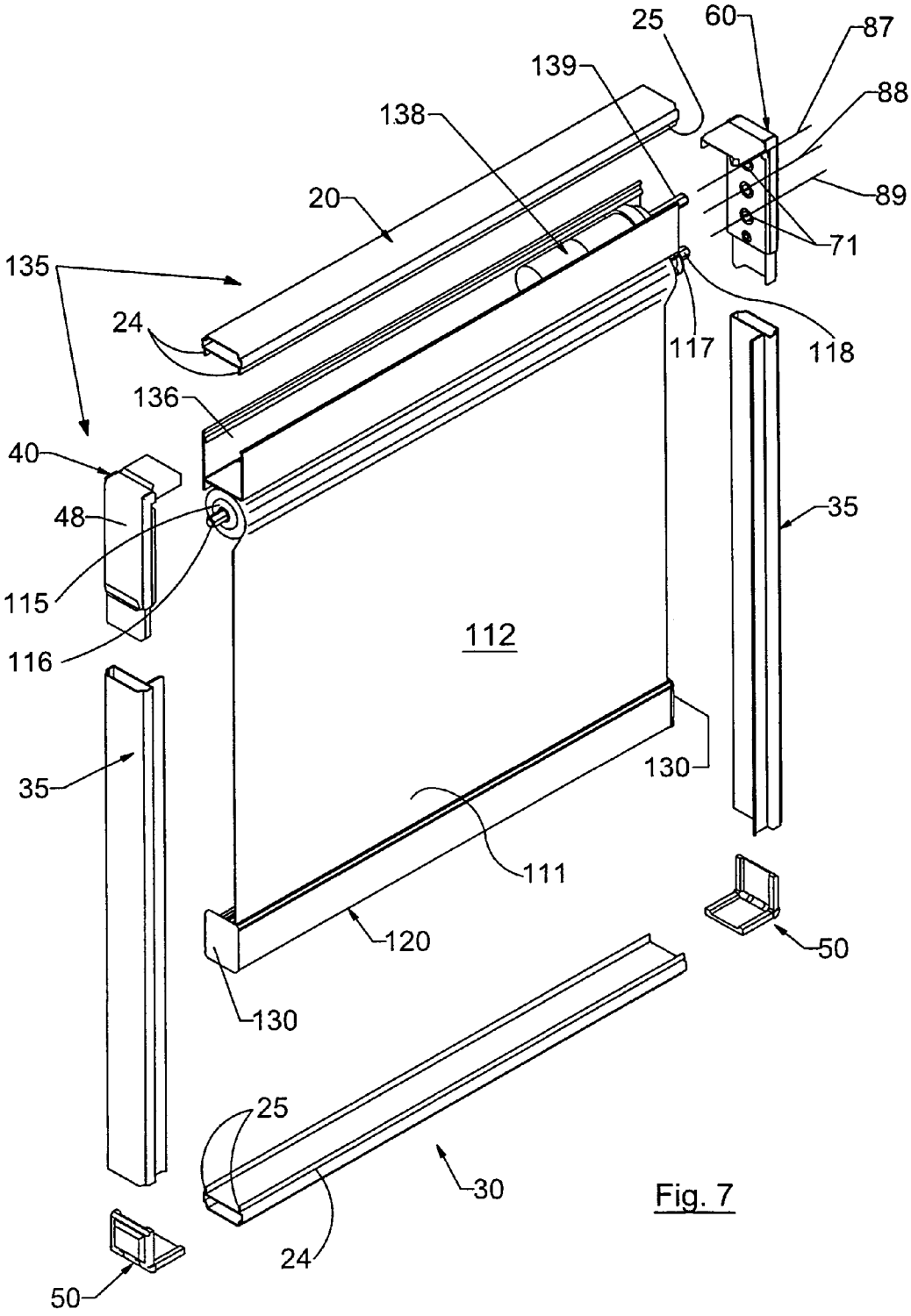

FIG. 7 Variant of the glass-enclosed chamber, with an electric motor instead of the internal magnetic device, exploded perspective view.

Figure 8:
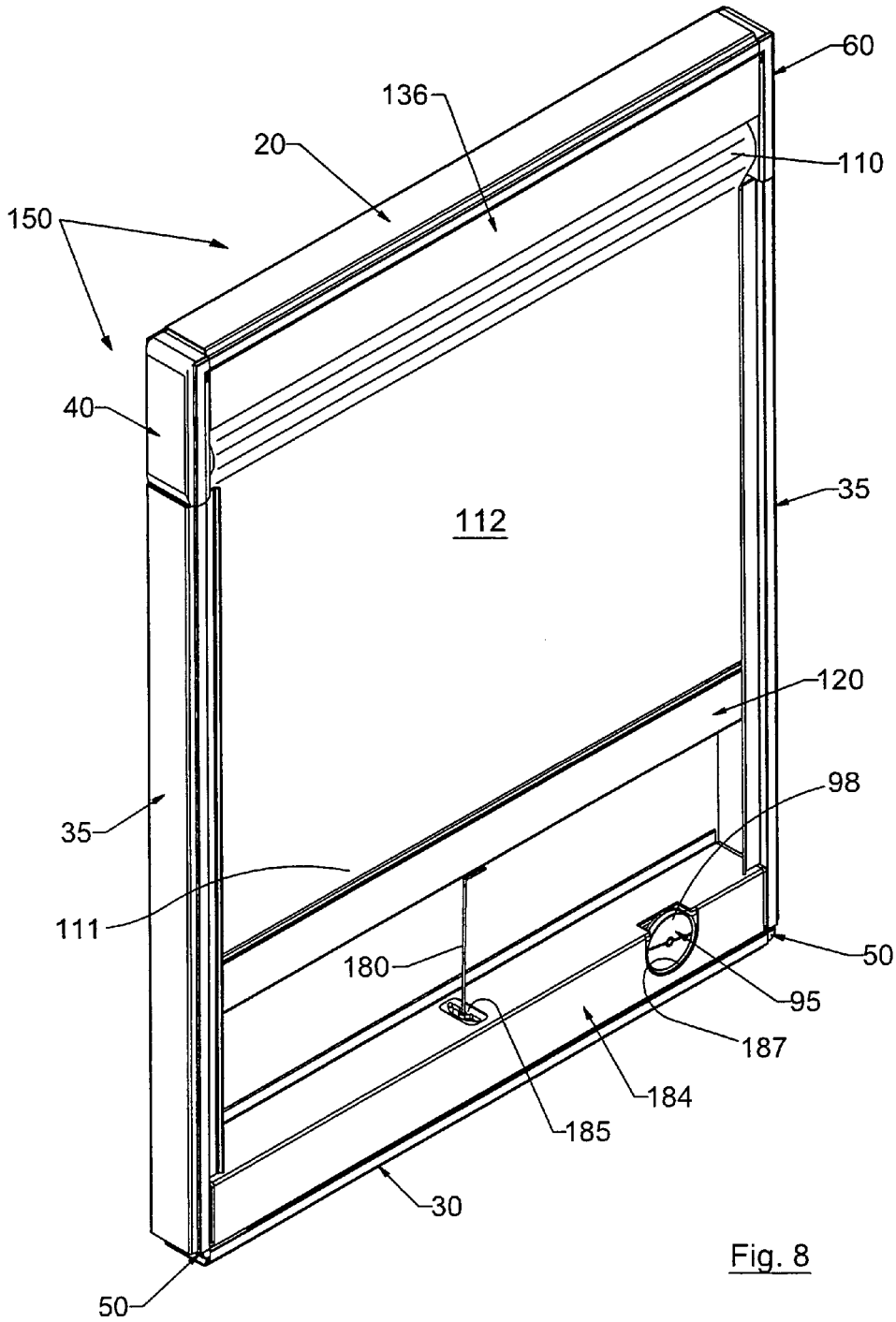

FIG. 8 Second variant of the chamber with the blind wound by a helical spring, and unwinding done by an internal magnetic device placed lower down, perspective.

Figure 9:
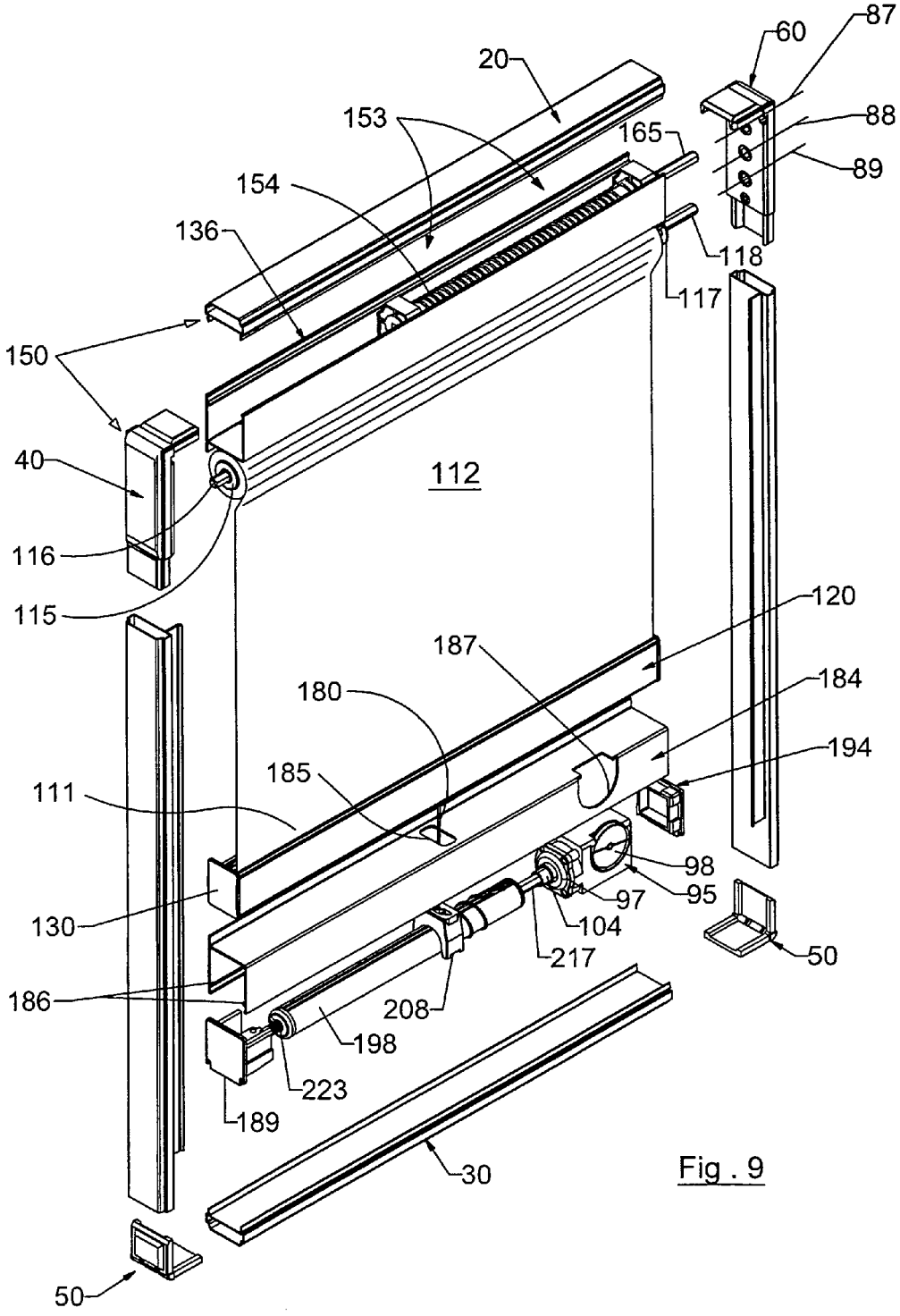

FIG. 9 Glass-enclosed chamber of FIG. 8, exploded perspective view.

Figure 10:
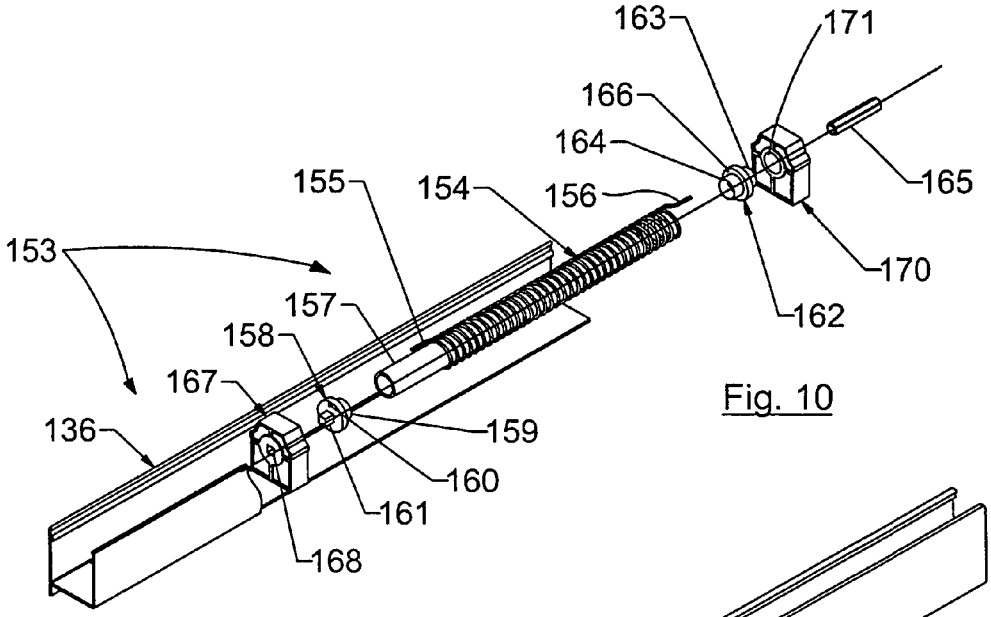

FIG. 10 Detail of the winding device, exploded perspective view.

Figure 11:
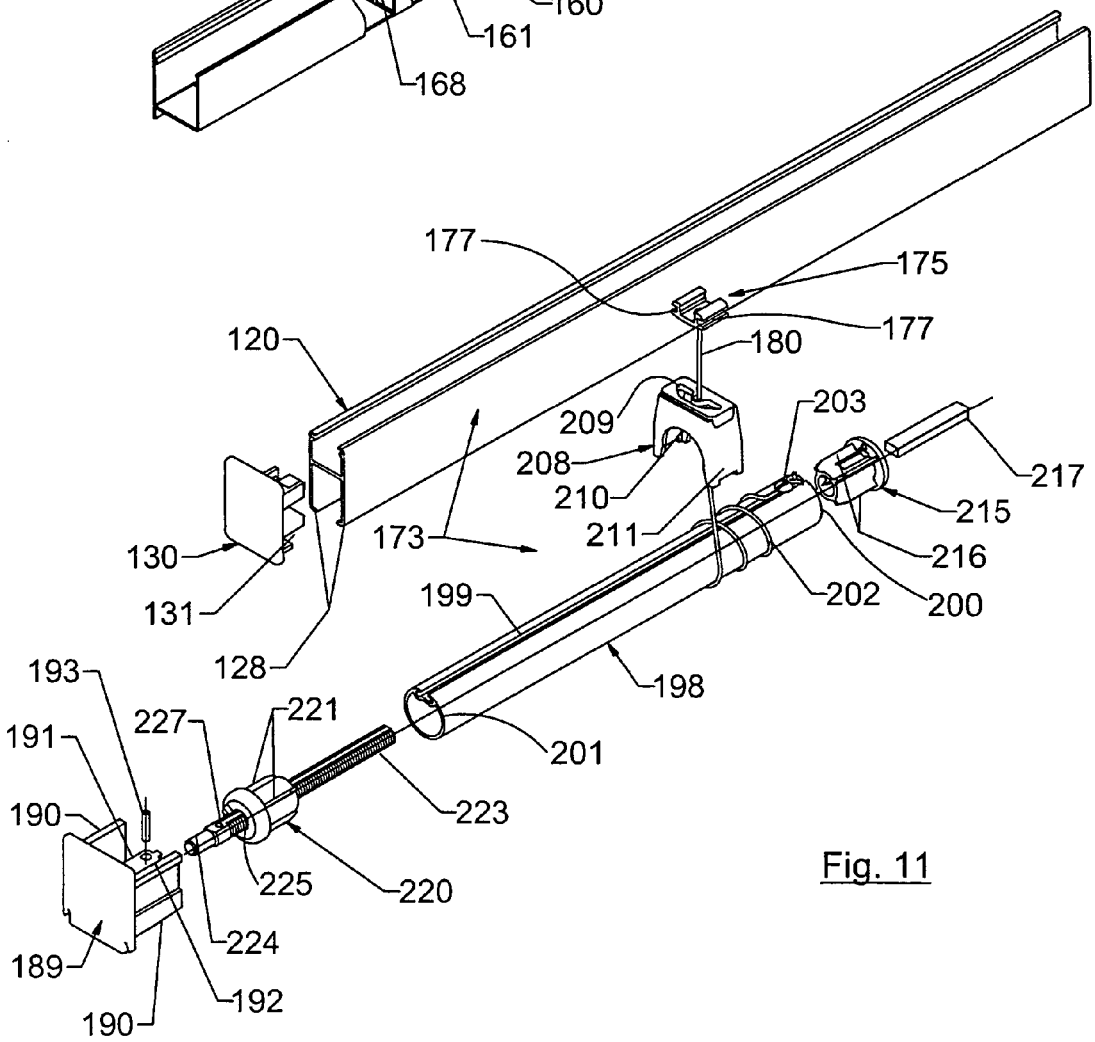

FIG. 11 Detail of the unwinding device, exploded perspective view.

Figure 12:
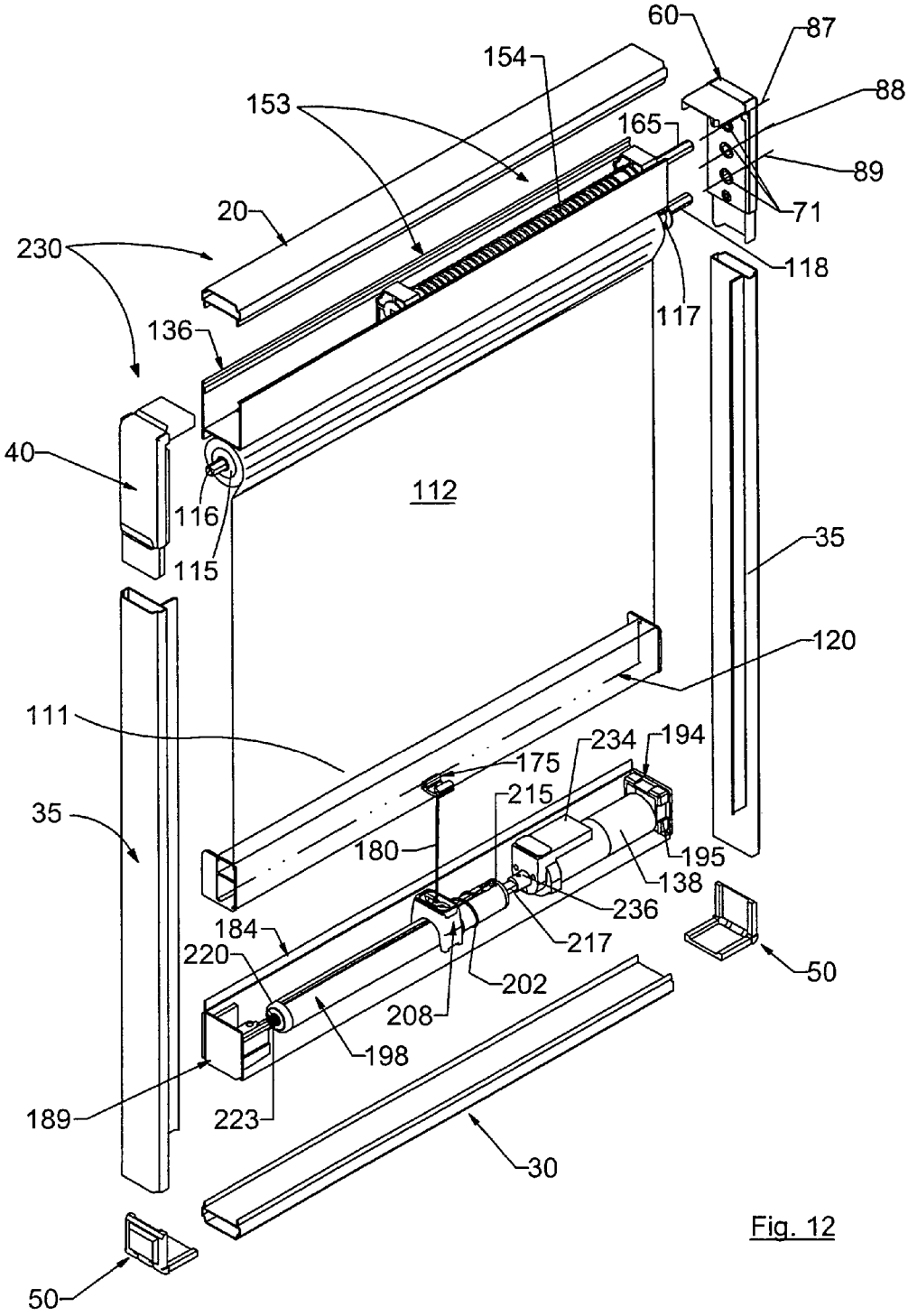

FIG. 12 Third variant of the chamber showing an electric motor replacing the internal magnetic device, exploded perspective view.

Figure 13:
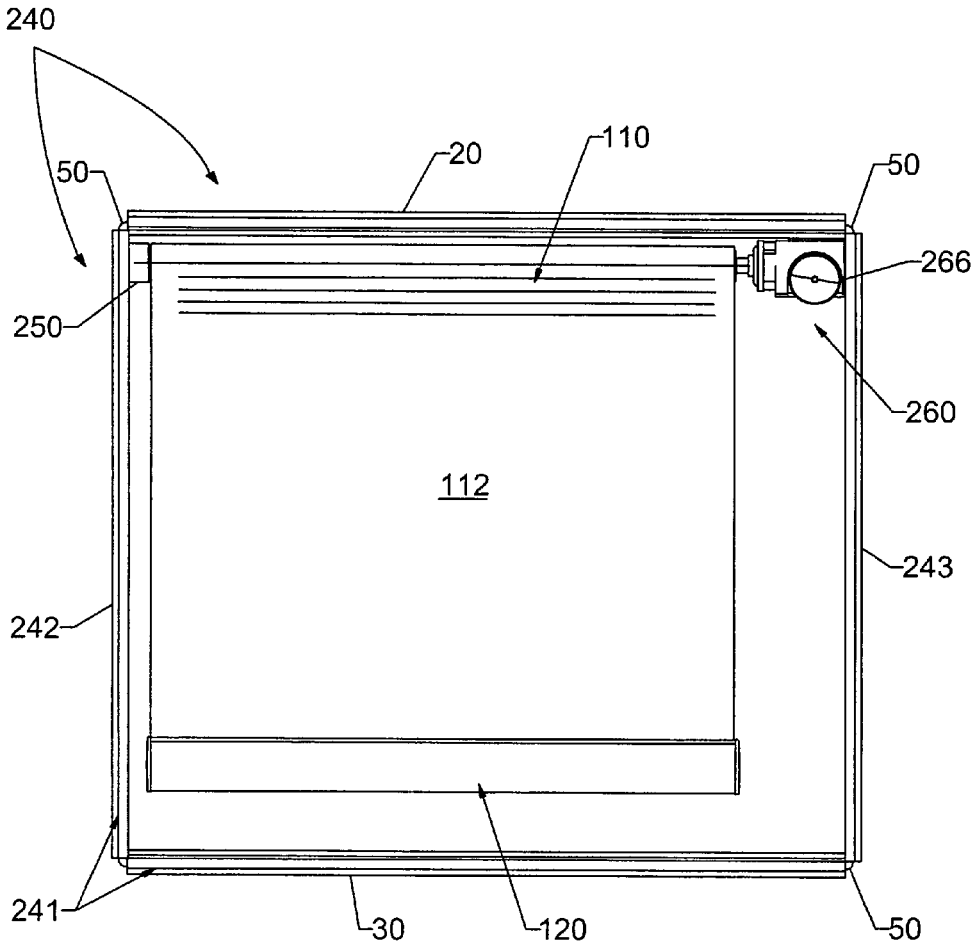

FIG. 13 Fourth variant of the chamber showing the magnetic device connected to the roller round which the blind is wound, front projection.

The glass-enclosed chamber 5 (FIGS. 1-6) comprises glass panes 6 and 7 and the frame 15.

The frame 15 is formed of a channel-shaped piece 20 across the top, one across the bottom 30 and two at the sides 35, all joined by a corner piece 40 top left, a corner piece 60 top right, and two at the lower corners 50.

The frame is assembled by pressing the projecting ends 42 (FIG. 2) of corner pieces 40, 50, 60 into the ends of bars 20, 30, 35.

Inside the frame at the top is a fixed box 106 having a squared U-shaped section and inward-facing hook-shaped ends 108 (FIG. 2). The upper channel-shaped bar 20 presents external ribs 24 and outward-facing hook-shaped ends 25 so that box 106 can be assembled to said upper bar 20 (FIG. 2) by pressing its hooks 108 against the hooks 25 on the upper box 20.

The top left corner piece 40 comprises an oblong body 48.

The top right corner piece 60 comprises an oblong body 65 and an opposing inner wall 67 (FIGS. 2, 4) fixed by screws 68 that, passing through the holes 72 in said opposing inner wall, screw into the threaded holes 74.

Said inner wall covers the space 66 for housing the pinions 78-80, axes of symmetry being respectively 87-89, there being through this wall shaped holes 81-83 surrounded, on both sides, by collars such as 84, that freely turn in the opposing holes 70 in parts 65 and 71 of the opposing inner wall 67.

At its top 110 the blind 112 is wound round the cylindrical roller 113 (FIG. 3), to which a certain internal shape 114 has been conferred. Plugs 115 and 117 are inserted in the two ends of said roller, the ends being shaped 119 to correspond with the internal shape of the roller, and having respectively shaped pins 116 and 118.

The magnetic device 95 (FIGS. 1, 2, 5) presents a body 96, front flange 97 and magnetic disk 98 whose shaft 99 presents the worm screw 100 meshing with the teeth 103 of the shaft 104 integral with a pin 105 shaped to correspond to the shape of the hole 81 in the pinion 78 (FIG. 4).

By means of said shaped pin 105 inserted in said hole 81 in said pinion 78 through one of the holes 71 in the opposing inner wall 67 of the corner piece 60, the movement made by the magnetic device 95 is transmitted, through the central idle pinion 79, to the pinion 80.

The pin 118, integral with roller 113 (FIG. 3) carrying the blind 112, fits inside the hole 83 in said pinion 80.

The opposite end 111 of the blind 112 is fixed to the lower mobile hollow bar 120 (FIG. 3) whose internal edges comprise the upper ribs 125 and lower ribs 128.

The plugs 130, with extensions 131, can therefore be fitted into the two ends of said hollow bar 120.

The blind is worked from the outside by a control device with a magnetic disk 12 (FIG. 6) rotated by an electric motor, or by a kinematic mechanism fitted with a manually operated continuous cord.

By opposing said magnetic disk 12, through the pane of glass 6, to the magnetic disk 98 on the operating device 95, the blind can be wound up and also let down exploiting the force of gravity generated by the weight of the mobile hollow bar 120 attached to the blind's lower end.

The lateral channel-shaped bars of the frame 35 present covering strips 37.

FIG. 7 shows a first variant 135 of the glass-enclosed chamber 5 in which the magnetic disk operating device 95 is replaced by an electric motor 138 mounted inside an upper fixed box 136 and connected through the frame to a source of electric current.

The end 139 of the shaft of the motor 138 is of substantially the same size and shape as the pin 105 fixed to the shaft 104 of the operating device 95.

By introducing said end 139 into the shaped hole 81 in the pinion 78 (FIG. 4), the blind can therefore be rolled up or let down in the usual way by means of the electric motor 138.

FIGS. 8-11 illustrate a second version 150 of the glass-enclosed chamber (FIGS. 9, 10), in which the fixed box 136 houses a tensioning means 153 with a helical spring 154 wound onto the roller 157.

At one end said roller 157 is supported by a fixed annular head piece 158 with a tubular extension 159 that fits into the roller, and by a shaped pin 161 at the opposite end that penetrates inside the shaped seat 168 of a support 167 mounted inside the box 136.

Cut in said fixed head piece 158 is the first notch 160 for retaining one end 155 of the spring 154 (FIG. 10).

At its other end said roller 157 is similarly supported by an annular head piece 162 whose tubular extension 164 freely turns inside the roller 157, and having a collar 163 freely turning in the round hole 171 in the support 170 this too mounted inside the box 136.

Cut in said head piece 162 is the second notch 166 for retaining the other end 156 of the spring 154.

One end of the shaped pin 165 is inserted inside the head piece 162 while the other end fits into the shaped hole 81 in the pinion 78 mounted in the corner piece 60 (FIG. 4).

When the blind 112 is unwound, the pin 118 in the roller 113, around which the blind is rolled, determines, by means of the kinematic mechanism created by the three pinions 78-80 (FIG. 4), rotation of the small shaped pin 165 which therefore winds up the spring 154.

The blind is unwound by means of device 173 (FIG. 11) that works as follows.

The U-shaped support 175, mounted inside the lower hollow mobile bar 120, comprises two grooves 177, one on each side, that fit onto the ribs inside said bar 120.

Fixed to said support 175 is the cord 180 that, through the slot 185 (FIG. 9) in the fixed box 184, with its two terminal plugs 189 and 194, passes inside the arched support 208 and winds round the roller 198.

Said arched support 208 is held stable inside the fixed box 184 (FIGS. 9, 11) by its sides 211 and by its top 209 that fit respectively against the walls, against the ribs 186, and against the base of the box 184.

Through the arch 210 in said support 208 the roller 198 (FIG. 11), worked by the device 95, freely rolls so winding around it the turns 202 of the cord 180.

Winding becomes possible because, through the bushing 215, fixed by the presence of ribbing 216 to one end 200 of the roller 198, a shaped axial hole is made to house the small shaped pin 217 fixed to the end of the short shaft 104 of a magnetic operating device 95, mounted in the fixed box 184, the position of whose magnetic disk 98 is made to correspond with that of the hole 187 in said box 184.

At the other end 201 of the roller 198, ribbing 221 fixes the bushing 220 axially presenting a threaded hole 225 inside which the threaded rod 223 is fitted.

The head 224 of said rod is fixed inside the support 191 in the plug 189 which, by means of the flange 190, fits into one end of box 184. Passing through support 191 is a hole 192 for insertion of a pin 193 inside the transversal hole 227 through the head 224 that holds the rod 223 stable.

When the operating device 95 turns, acting on the disk 98, the bushing 220, screwed into the threaded rod 223, causes the roller 198 to rotate and to translate and, in so doing, wind the cord 180 around it.

The pull made by said cord 180 unwinds the blind 112 thus winding up the spring 154 on the spring device 153.

When the operating device 95 turns in the opposite direction, the pull exerted by the spring 154 winds the blind 112 round its roller 113 therefore unwinding the cord 180 from the roller 198.

FIG. 12 illustrates a third version 230 of the glass-enclosed chamber; in this case, in place of the operating device 95 with its magnetic disk, an electric motor 138, supported by the bracket 234, is installed in the lower fixed box 184.

The shaped rod 217 fits into an axial seat in the short shaft 236 of said electric motor 138.

FIG. 13 shows a fourth version 240 of the glass-enclosed chamber wherein the frame 241 comprises two vertical channel-shaped bars 242, 243 joined to the horizontal bars by corner pieces 50 ad described.

At one end the roller for the blind 112 turns freely on a support 250 fixed to the hollow bar 242.

At the other end the roller is fixed to the shaft of magnetic device 260, presenting substantially the same characteristics as device 95 (FIG. 9).

Device 260 is installed in a position 266 where it is supported by the lateral channel-shaped bar 243 itself.

The invention claimed is:

1. A system for operating a blind (112) inside a chamber (5, 150) enclosed by panes (6, 7) surrounded by a frame (15), the frame comprising side hollow bars (20, 30, 35) connected by corner pieces (40, 50, 60), the system comprising:

a blind-roller (113) supported inside said chamber (5, 150), wherein a first end of the blind (112) is fixedly connected to the blind roller (113);

a kinematic mechanism placed inside an oblong body (65) fixed to a corner piece (60), wherein said mechanism includes three mutually engaged pinions (78, 79, 80), a first pinion (80) of which axially connected to the blind roller (113); and a first box (136) supported inside said chamber (5, 150) fixedly to a first end of the frame (15);

wherein said blind (112) comprises:

first pulling means (153) supported inside said first box (136), the first pulling means including a helical spring (154) wound around a spring-roller (157) axially connected to a second pinion (78) of the kinematic mechanism by the interposition of an intermediate idle third pinion (79);

second pulling means (173), comprising:

a mobile bar (120) fixedly connected to a second end (111) of the blind (112);

a second box (184) supported inside said chamber (5, 150) fixedly to a second end of the frame (15) opposite to a first end of the frame;

a cord (180) having one end fixed to a center of the mobile bar (120) and a second end fixed to a cord-roller (198) supported inside the second box (184);

a first pin (217) axially engaged with a first end of the cord-roller (198) and orthogonally engaged by a fourth pinion (103) and worm screw (100) with a shaft (104) of a first magnetic disk (98) disposed within the second box (184) and matching with an internal surface of the pane (6) of enclosed chamber (5, 150); and a threaded bushing (225) fixed to a second end of said cord roller (198) that screws into a threaded bar (224) fixed to the frame (15) for translating the said cord roller (198) axially to accommodate turns (202) made by said cord (180); and a second magnetic disk (12) rotated by external operating means and matching, at the position of the first magnetic disk (98), with the external surface of the pane (6) of the enclosed chamber (5, 150).

2. The system as in claim 1, further comprising an arched support (208) held inside the second box (184), the arched support hooked to the center of the cord-roller (198) and crossed by the cord (180).

3. The system as in claim 1, wherein another end (155) of said helical spring (154) is connected to a fixed support (167) inside the first box (136).

4. System as in claim 1, characterized in that the external operating means comprises a continuous cord workable by hand, applied to a pulley fixed to a gearing-up device.

5. System as in claim 1, characterized in that the external operating means is an electric motor.

* * * * *